US005181584A

United States Patent [19]

Simard

[11] Patent Number: 5,181,584

[45] Date of Patent: Jan. 26, 1993

[54] LADDER LEVELING ADAPTER

[76] Inventor: Yves M. Simard, 410, Route 381, Ferland, Quebec, Canada, G0V 1H0

[21] Appl. No.: 851,580

[22] Filed: Mar. 16, 1992

[51] Int. Cl.[5] ..... E06C 7/00

[52] U.S. Cl. ..... 182/201; 182/107

[58] Field of Search ..... 182/201, 200, 202, 203, 182/204, 205, 107

[56] References Cited

U.S. PATENT DOCUMENTS

| | | | |
|---|---|---|---|
| 992,408 | 5/1911 | Drake | 182/201 |
| 1,323,227 | 11/1919 | Kirby | 182/201 X |
| 2,147,052 | 2/1939 | Noone | 182/205 |
| 2,245,306 | 6/1941 | Smith | 182/203 |

*Primary Examiner*—Alvin C. Chin-Shue
*Attorney, Agent, or Firm*—Roland L. Morneau

[57] ABSTRACT

The ladder leveling adapter comprises a pair of spacers adapted to be secured outwardly on the side rails of the ladder between two interconnecting rounds. An elongated bar having a median slot parallel to the rail extends over the spacers and projects below the rails. Each rail and each adjacent elongated bar are connected together by a pair of threaded rods having a nut threadedly mounted on the inner side of the rail and quick release tightening means on the outer side of the bar. A friction means is mounted around each rod between the spacer and the bar for preventing a longitudinal slipping between the bar and the rail. The quick release tightening means comprises a knob axially mounted on the rod having a flat surface abuting on the bar and a lever for slidingly moving the knob against the bar. The knob includes a pin which extends in the slot of the bar for preventing the rotation of the lever relative to the slot, the pin having a length greater than the releasing distance of the release means.

6 Claims, 3 Drawing Sheets

LADDER LEVELING ADAPTER

BACKGROUND OF THE INVENTION

1. Field of the invention

This invention relates to a ladder leveling adapter and more particularly to an adapter having legs to be mounted on a common ladder in order to stand vertically on an uneven surface.

The present adapter is particularly designed to be adjusted quickly, with precision, and be completely reliable to support heavy weights climbing the ladder even beyond the expected capacity.

2. Prior art

A plurality of ladder leveling attachments have been contemplated which require a toothed arrangement such as in U.S. Pat. Nos. 2,127,884 3,083,788 and 3,882,966 and Canadian Pat. Nos. 138,945 and 468,425. The manufacturing of such a design is relatively expensive considering that a toothed surface requires an elaborate mode of production. Furthermore, toothed surfaces provide a leveling adaptation which is not continuous and accordingly, is not suitable when a precise adjustment of the legs on the side rails is needed. This is particularly the case when the ladder is long and a small difference in level causes the ladder to tilt excessively.

U.S. Pat. No. 3,406,785 discloses a ladder supporting surface compensating means making use of a continuous sliding rod on the side of the ladder. This compensating means is particularly adapted for a wooden ladder wherein the attachment is bolted to the ladder and the tightening means frictionally engages the rod. Such an arrangement substantially compares to the one described in Canadian Pat. No. 629,827.

An elaborate leveling device is described in U.S. Pat. No. 5,044,468. Hydraulic pistons are mounted on each side of the ladder and are adapted to selectively adjust according to the height of the ground on which they stand.

None of the above ladder leveling device are concerned with the production of inexpensive adapters which can be raised continuously and be securely locked quickly.

SUMMARY OF THE INVENTION

The ladder leveling adapter according to the invention comprises a pair of spacers adapted to be secured outwardly on the side rails of thee ladder between two interconnecting rounds. An elongated bar having a median slot parallel to the rail extends over the spacers and projects below the rails. Each rail and each adjacent elongated bar are connected together by a pair of threaded rods having a nut threadedly mounted on the inner side of the rail and quick release tightening means on the outer side of the bar. A friction means is mounted around each rod between the spacer and the bar for preventing a longitudinal slipping between the bar and the rail.

The quick release tightening means comprises a knob axially mounted on the rod having a flat surface abuting on the bar and a lever for slidingly moving the knob against the bar. The knob includes a pin which extends in the slot of the bar for preventing the rotation of the lever relative to the slot, the pin having a length greater than the releasing distance of the release means.

It should be understood that the invention can comprise only one of the combinations of the threaded rods with its corresponding nut and its tightening means.

The other corresponding combination can be a guiding means such as a loose tie shaft extending through he median slot of a bar, a spacer and a rail combination essentially which correspond to the original one without the tightening means.

DETAILED DESCRIPTION OF THE INVENTION

Figure 1:
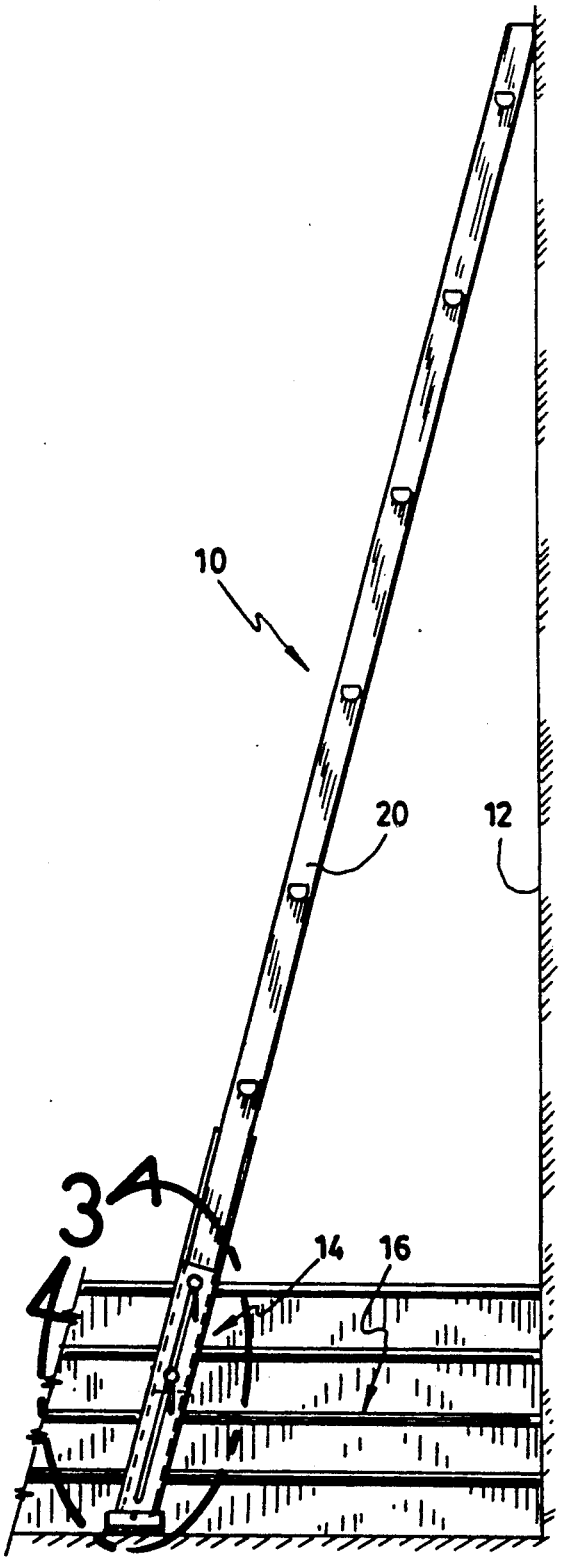
FIG. 1 is a side view of a ladder supported by a leveling adapter according to the invention.
Figure 2:
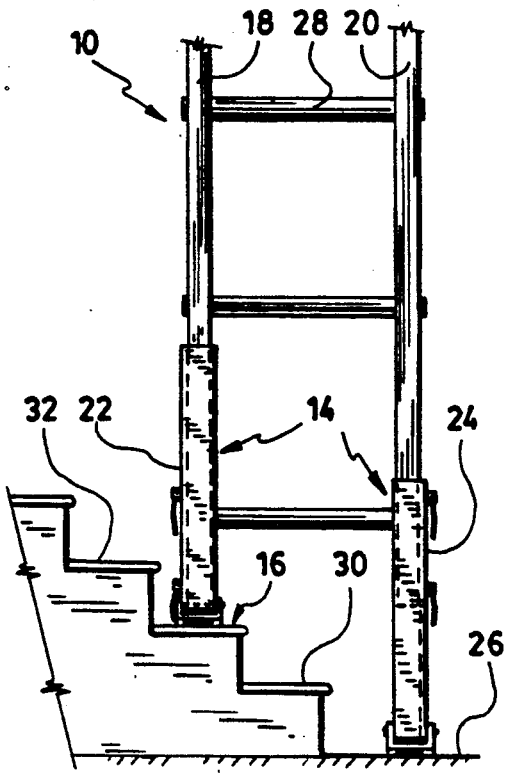
FIG. 2 is a front view of a part of the ladder supported by the leveling adapter according to the invention and resting partly on a staircase.

FIG. 1 illustrates a ladder 10 leaning against a wall 12 and supported by a leveling device 14 at the bottom of a series of steps 16 of a staircase. FIG. 2 illustrates a front view of the same ladder 10 having two rail sections 18 and 20 being respectively supported by leg members 22 and 24 of the leveling device 14. The leg members 22 and 24 are vertically adjustable on the rail sections 18 and 20 respectively so as to fit exactly according to the difference in level of step 16 relative to the floor 26. It is important that the leveling device 14 be able to adjust exactly to the levels desired so that the ladder will not tilt especially if the ladder is rather long. Considering the width of the ladder 10 exemplified by the space between the two rail sections 18 and 20, and in particular by the length of the rounds 28, an appropriate distance may be chosen to adapt to the distance between two steps such as 30 and 32 in FIG. 2 so as to stand squarely and solidly on such steps 30 and 32. Furthermore, the maximum difference in height between legs 22 and 24 may be chosen so as to take up the distance between steps 30 and 32. It is obvious that any intermediate difference in level could be taken car of by a suitably dimensioned system used according to the present invention.

Figure 3:
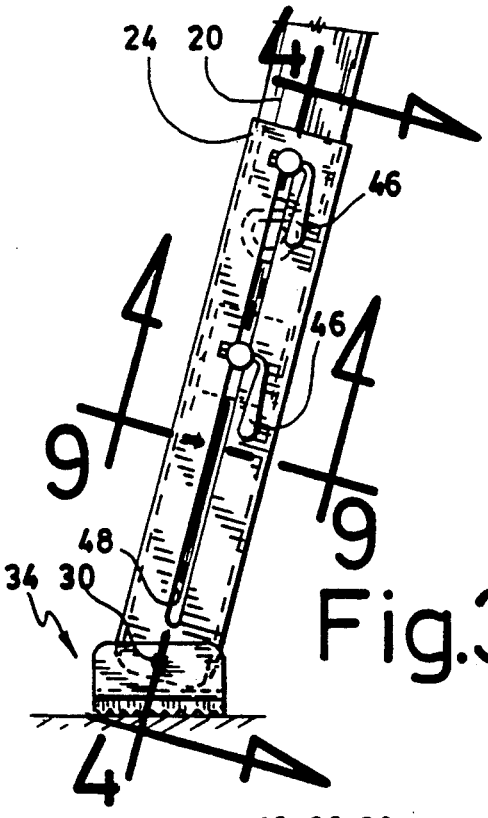
FIG. 3 is an enlarged view of encircled portion 3 shown in FIG. 1.

A foot member 34, as particularly shown in FIG. 3, is pivotally mounted on axle 36 at the bottom of the legs such as 24 to be able to stand squarely on a substantially horizontal floor when the ladder 10 is tilted such as shown in FIG. 1. The general structure illustrated in FIGS. 1, 2 and 3, as mentioned above, will now be explained in detail.

Figures 4, 5:
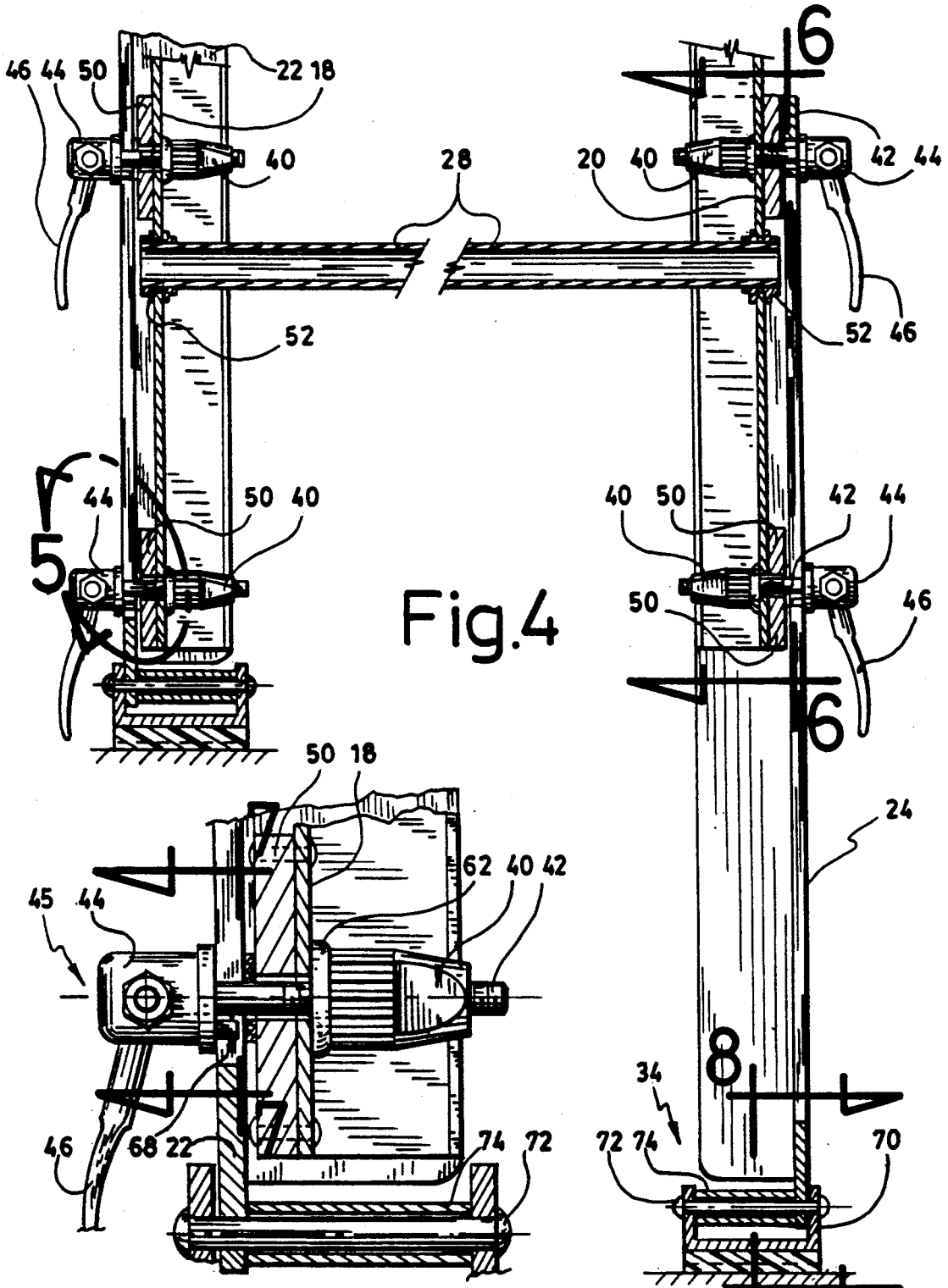
FIG. 4 is a cross-sectional view along line 4—4 of FIG. 3.
FIG. 5 is an enlarged view of encircled portion 5 shown in FIG. 4.
Figure 9:
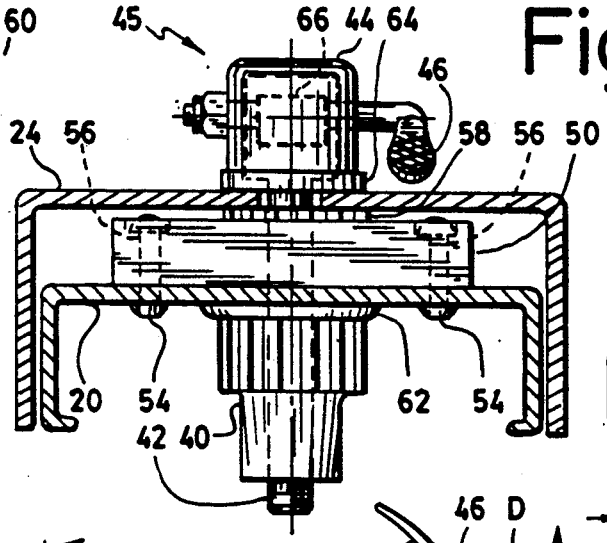
FIG. 9 is a cross-sectional view taken along line 9—9 of FIG. 3, FIGS. 10 and 10*a* are cross-sectional views of a quick releasing and tightening device adapted for tightening the leveling adapter to the ladder.

According to the present embodiment, the rail sections such as 20, have a C-shape cross-section and the legs such as leg 24 have a C-shape cross-sections also as particularly shown in FIG. 9. Such C-shape cross-sections are used for the purpose of illustration but could also be flat plates. FIG. 4 is a longitudinal cross-section through the leg part 24 sliding over the rail section 20 which are held together by the combination of a nut 40 mounted on a screw 42 extending both through the rail section 20 and the leg 24. The other end of the screw 44 is held by an eccentric clamp 44 which is operated by a lever 46 so as to slidingly operate the clamp 44. The screw 42 is mounted through a hole in rail section 20 and a slot 48 provided in the leg 24. The slot 48 allows the leg 24 to slide up and down the rail section 20 and move upwardly until the foot member 34 comes into abutment with the lower face 50 of the rail section 20 (see FIG. 4). The same leg 24 can be lowered until the upper end of the slot 48 abuts against the upper located screw 42. The combination of the nut 40, the screw 42, the eccentric clamp 44 with the lever 46 constitute a quick release system 45 for tightening the leg 24 to the rail section 20.

Two of such quick release systems 45 are used on each side of the ladder, one preferably below the lowest round 28 and one above the lowest round 28 and below the penultimate round above round 28 as shown in FIG. 4.

The same arrangement as explained for the right-hand side rail section 18 and leg 24 applies to the rail section 18 in combination with the leg 22. FIG. 5 is an enlarged portion of encircled part of FIG. 4 in order to illustrate more clearly the tightening action of the quick release system. A plate 50 is provided between the rail section 18 and the leg 22 in order to reinforce the rail section 18 and the leg 22 around the periphery of the screw 42. This plate 50 also constitutes a spacer between the rail section 18 and the leg 22 to prevent the leg 22 from interfering with the tip 50 of the round 28 which exceeds outside the rail section 18 or 20. The thickness of the plate 50 must always be greater than the tip 52 of the rounds outside the rail sections 18 and 20. The plates 50 are solidly secured to the rail sections such as 18 shown in FIG. 5 with rivets particularly shown in FIG. 9. The plate 50 is preferably provided with counterbores so that the head of the rivets 54 exceeds the surface of the plate 50 by a distance which does not exceed a predetermined height as explained later.

Figure 6:
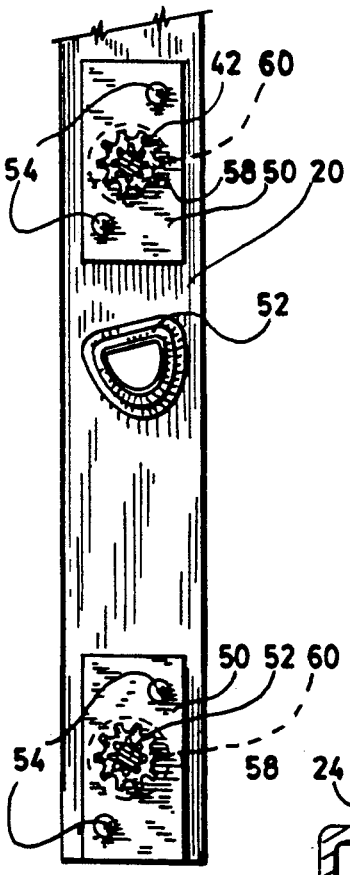
FIG. 6 is a cross-sectional view taken along line 6—6 of FIG. 4.
Figure 7:
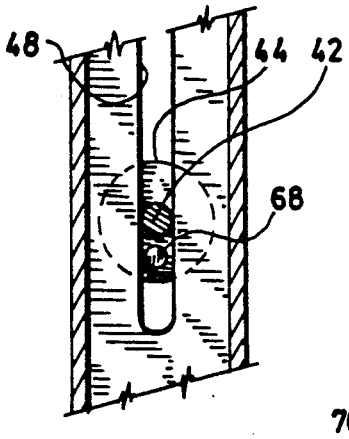
FIG. 7 is a cross-sectional view taken along line 7—7 of FIG. 5.
Figure 8:
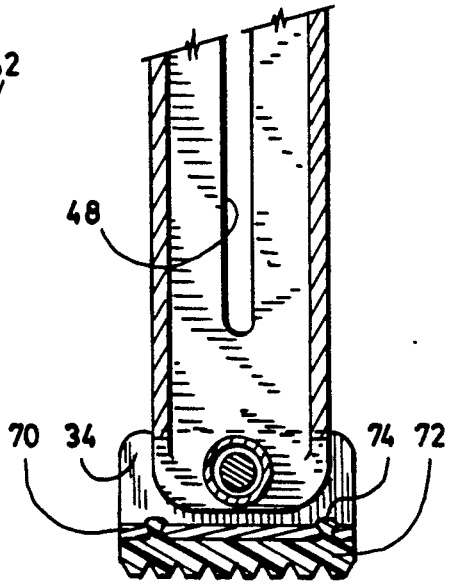
FIG. 8 is a cross-sectional view taken along line 8—8 of FIG. 4.

To further prevent the slipping or the rail section 20 and 18 relative to the legs 22 and 24 respectively, a friction element mounted around the screw 42 and inserted between the plate 50 and the leg 24 or 22. Such friction element is identified by a washer 58 having teeth 60 particularly shown in FIG. 6 around its periphery. The teeth 60 are twisted to provide a gripping corner on each side of the washer 58. Such a washer when inserted between the plate 50 and the rail section 24, as shown in FIG. 9, provides an anti-slipping element which prevents sliding motion between the rail section 20 and the leg 24 when the quick action release system is tightened. The anti-slipping action is further increased by using a steel washer 58 when the plate 50 and the leg 24 are made of a softer metal such as aluminum. The twisted teeth 60 bites into the aluminum when the quick release system 45 is tightened.

Considering that the washer 58 is relatively thin, the head of the rivots 54 must exceed above the surface of the plate 50 by a distance smaller than the thickness of the washer. For this reason, counterbore 56 are usually preferred.

The tightening effect of such an arrangement is very strong considering that the nut 40 has a large rim 62 abutting against the rail section 20 and the knob of the eccentric clamp 44 has also a large rim 64 which abuts against the leg 24. The combination of large surfaces of the rims 64 and 62 with a washer having a substantially similar size provides the desired anti-slipping action above the usual requirements which would include two persons standing in the ladder or a person carrying a load.

The friction may further be increased by providing a serrated surface on the surface of the rim 64 adjacent the leg 24. The motion of the eccentric clamp 44 is obtained by an eccentric drum 66 mounted inside the clamp 44 and actuated by the lever 46.

Figure 10:
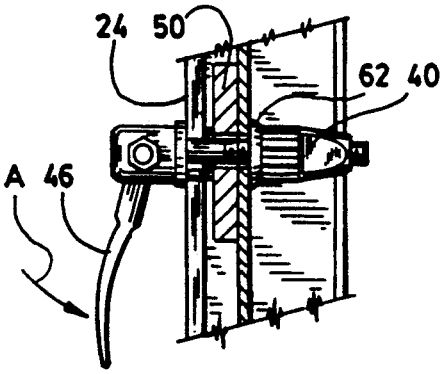
Figure 10A:
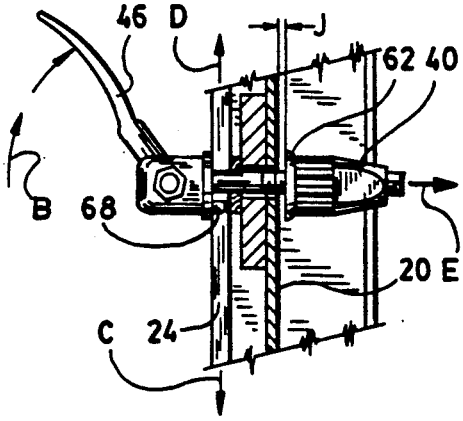

The operation of the quick release action is particularly illustrated in FIGS. 10 and 10*a* wherein in FIG. 10 the lever is pushed in the direction of the arrow A which causes the eccentric clamp to move in the direction of the leg 24 while the nut 40 is previously adjusted to provide a strong tightening effect between the leg 24, the plate 50 and the nut 40. In order to release the above mentioned tightening effect, the lever 46 is moved upwardly in the direction of the arrow B allowing the leg 24 to move upwardly in the direction of the arrow B or downwardly in the direction of the arrow C. Such upward movement of the lever 46 operates the eccentric drum to push the nut 40 in the direction of the arrow E and accordingly provide a spacing J between the rail section 20 and nut 40. This spacing J is sufficient to allow easy movement of the leg 24 in an upward and downward direction.

As particularly shown in FIG. 3, the lever 46 is parallel to the direction of the rail section and the leg 24. It is preferred to maintain this direction of the lever 46 because, if the lever 46 would adopt a cross-wise orientation relative to the leg, it could exceed the width of the leg 24 and accordingly be unfastened or untightened unintentionally. In order to maintain such an orientation, the eccentric clamp 44 is provided with a pin 68 adapted to extend into the slot 48 and accordingly prevent the clamp 44 and the lever 46 to rotate about the axis of the screw 42. It is pointed out that the length of the pin 68 must always remain inside the slot 48 and accordingly must be longer than the dimension J explained in FIG. 10*a*. Otherwise, the pin 68 could raise above the slot 48 and allow the lever 46 to rotate about the axis of the screw 42. Although the pin 68 is specially illustrated to prevent the rotation of the lever 46 relative to the axis of the slot 48, other equivalent means for preventing the rotation of the lever 46 are contemplated. For instance, the portion of the screw 42 extending in the slot 48 may be provided with such a rectangular cross-section for allowing the sliding of the screw 42 in the slot 48 while preventing its rotation thereinto.

The legs 22 and 24 are supported by foot member 34 which are characterized by a C-shape member 70 held along one of its side faces to the leg 24 as shown in FIGS. 4 and 5. The two side faces of the C-shape member 70 are interconnected by a rivet 72 and surrounded by a sleeve 74 extending between both side faces of the C-shape member 70. Such a foot member provides a solid support for the legs 22 and 24 and allows a pivoting action relative to the side rails 18 and 20 of the ladder. It is further proposed to increase the friction between the foot member 34 and the ground by providing a rubberized material below the C-shape member 70. The rubber lining 72 is hooked to the C-shape member 70 by a pair of protuberant beads projecting into holes in the lower surface of the C-shape member 70.

A ladder leveling device of the type described provides a quick adjustment and a strong and reliable tightening device for any situation wherein such adjustment is required. The fact that it is quick to operate constitutes an important characteristic of the invention because it has been found that people using ladders would rather accept to step on a slightly sideways tilted ladder than to operate a system that is too elaborate. Furthermore, the present system enables a continuous adjustment for any uneven surface on which the ladder must stand. When the ladder is considerably long, such as over 12 feet, a small difference in level of the ground can often cause an accident for a careless worker. The system has also been adapted to maintain the levers 46 in a direction parallel with the direction of the rail sections to prevent any unintentional releasing action if the lever 46 is located sideways while a worker is in the ladder.

As state above, the present system is particularly suitable for aluminum ladders with which an aluminum leg 22 and 24 are used in combination with an aluminum plate 50. Aluminum ladders are frequently provided with rounds 28 having tips 52 exceeding outside the rail sections 18 and 20 and the plate 50 as contemplated in the present invention overcomes the endurance of such tips 52. However, the same adapters can be used with wooden ladders and ladders made of fiberglass.

I claim:

1. A ladder leveling adapter for a ladder having two side rails and a plurality of connecting rounds joining said side rails, said adapter comprising,

- an elongated bar adapted to be mounted over each of said rails and to extend below said rails, said bars being provided with a median slot parallel to said rails,
- a pair of spacers adapted to be mounted between each of said rails and said bars, on each side of one of said rounds,
- a rod slidingly mounted through each of said spacers, said rods extending through said slots and said rails,
- a nut threadedly mounted on each of said rods for abutting against said rails,
- a quick release tightening means mounted on each rod for tightly and releasably abutting against said bars,
- friction means surroundingly mounted loosely around each of said rods between each of said spacers and said bars, for preventing longitudinal slipping between the bars and the rails, whereby said bars and said rails are longitudinally and precisely adjustable relative to each other and quickly tightened and released.

2. A ladder leveling adapter as recited in claim 1, for a ladder having rounds extending outwardly of said rails by a predetermined width, said spacers being flat plates having a thickness corresponding to said predetermined width, and said friction means is a washer having tongues radially projecting on its periphery, said tongues being twisted to grippingly project on both sides of said washer, said tongues adapted to prevent longitudinal movement between said bars and said plates when said quick release means is tightened.

3. A ladder leveling adapter as recited in claim 2 for a ladder having side rails with U-shaped cross-section, said bars having a U-shaped cross-section adapted to overlappingly ride on said rails and said plates for facilitating the sliding of the bars over the rails.

4. A ladder leveling adapter as recited in claim 3, wherein the quick release means comprises a knob axially mounted on said rods, and a lever for slidingly moving said knob against the bars, whereby said knobs are adapted to tighten the bars to the rails when the nuts are predeterminedly adjusted on the rods.

5. A ladder leveling adapter as recited in claim 4, wherein each of said knobs comprises a pin extending in said slot, said pins adapted to prevent the rotation of said levers relative to said slots.

6. A ladder leveling adapter as recited in claim 5, wherein said spacers are riveted to said rails.

* * * * *